US008246320B2

(12) United States Patent
Park et al.

(10) Patent No.: US 8,246,320 B2
(45) Date of Patent: Aug. 21, 2012

(54) MUFFLER FOR COMPRESSOR

(75) Inventors: Dong-Woo Park, Changwon (KR); Min-Kyu Jung, Changwon (KR)

(73) Assignee: LG Electronics Inc., Seoul (KR)

( * ) Notice: Subject to any disclaimer, the term of this patent is extended or adjusted under 35 U.S.C. 154(b) by 218 days.

(21) Appl. No.: 12/920,603

(22) PCT Filed: Dec. 31, 2008

(86) PCT No.: PCT/KR2008/007896

§ 371 (c)(1),
(2), (4) Date: Sep. 2, 2010

(87) PCT Pub. No.: WO2009/110677

PCT Pub. Date: Sep. 11, 2009

(65) Prior Publication Data

US 2011/0014065 A1 Jan. 20, 2011

(30) Foreign Application Priority Data

Mar. 4, 2008 (KR) ..... 10-2008-0020219

(51) Int. Cl.
*F04B 39/00* (2006.01)
*F04B 53/00* (2006.01)
*F02M 35/00* (2006.01)

(52) U.S. Cl. ..... 417/312; 417/540; 181/229

(58) Field of Classification Search ..... 181/403, 181/229, 264, 276; 417/312, 540, 902
See application file for complete search history.

(56) References Cited

U.S. PATENT DOCUMENTS

| | | | | |
|---|---|---|---|---|
| 4,793,775 | A * | 12/1988 | Peruzzi | 417/312 |
| 5,584,674 | A * | 12/1996 | Mo | 417/312 |
| 5,733,106 | A * | 3/1998 | Lee | 417/312 |
| 6,398,523 | B1 | 6/2002 | Hur et al. | |
| 6,415,888 | B2 * | 7/2002 | An et al. | 181/281 |
| 2005/0042115 | A1 * | 2/2005 | Jung et al. | 417/312 |
| 2006/0045762 | A1 * | 3/2006 | Lee | 417/312 |

OTHER PUBLICATIONS

International Search Report and Written Opinion dated Sep. 14, 2010. (Application No. PCT/KR/2008/007896).

* cited by examiner

*Primary Examiner* — Devon Kramer
*Assistant Examiner* — Bryan Lettman
(74) *Attorney, Agent, or Firm* — KED & Associates LLP

(57) ABSTRACT

A muffler for a compressor has a chamber between an inlet and an outlet and a communicating pipe for indirectly connecting the inlet to the outlet, whereby a suction loss of a refrigerant sucked into the muffler for the compressor can be reduced and also pressure pulsation can be reduced so as to enhance a cooling capability of the compressor and achieve a noise reduction effect. Also, an assembling structure of the muffler can be simplified, resulting in reduction of fabricating cost and improvement of productivity.

13 Claims, 4 Drawing Sheets

[Fig. 1]
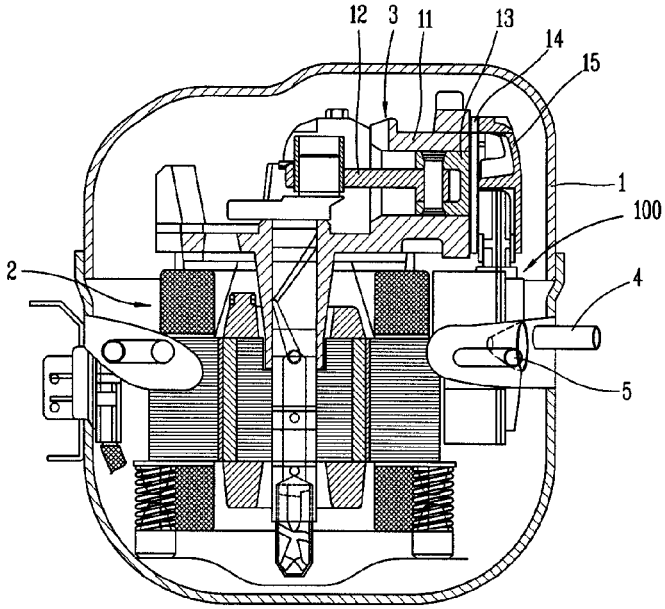
[Fig. 2]
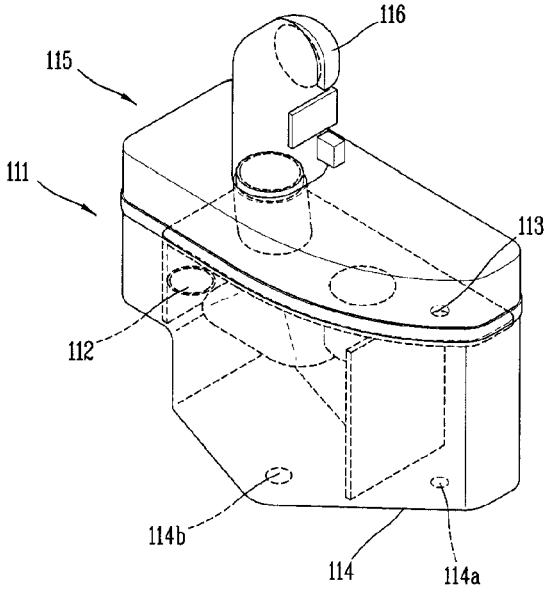
[Fig. 3]
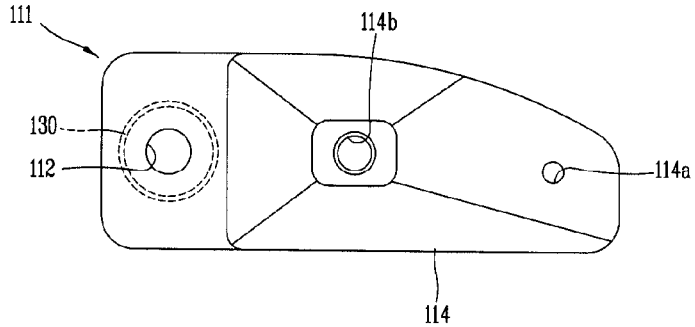

[Fig. 4]
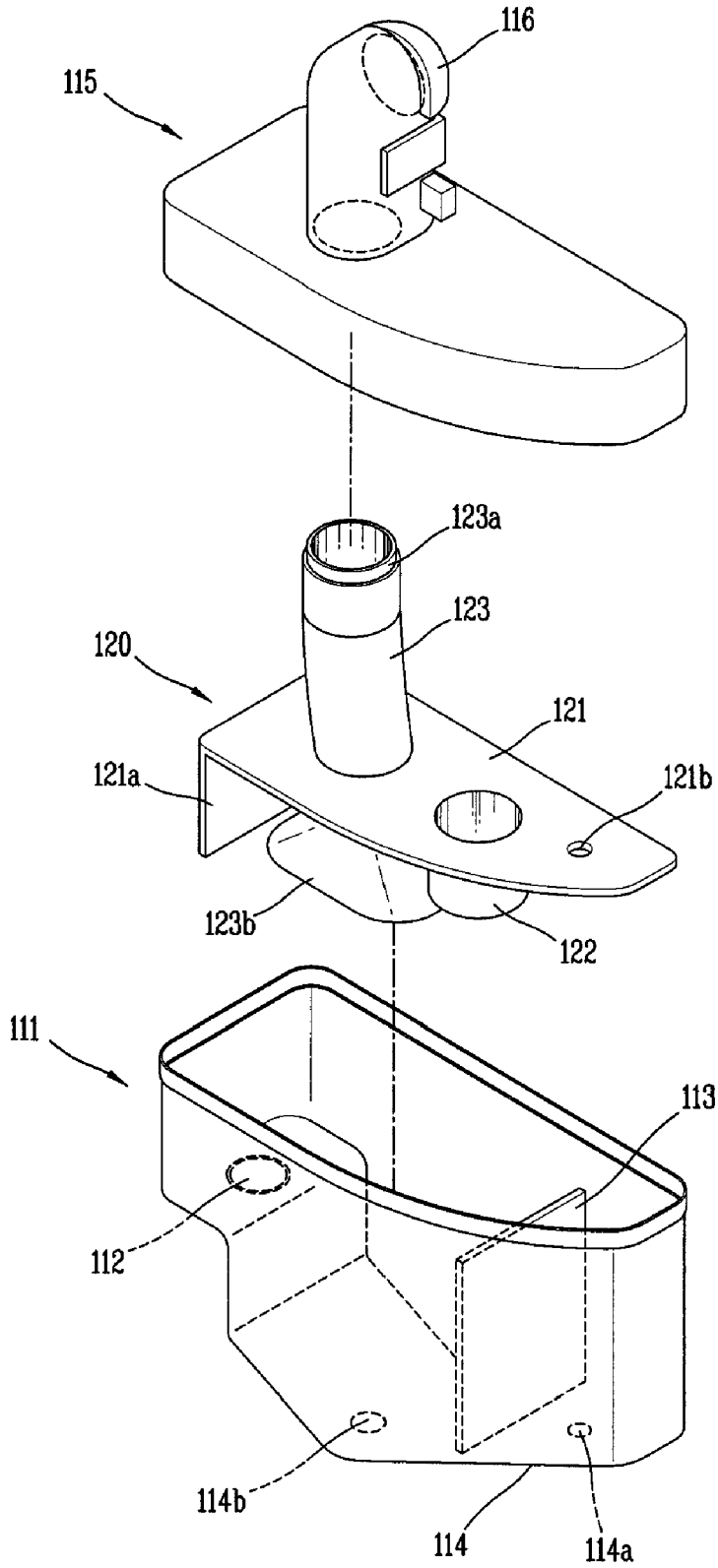

[Fig. 5]
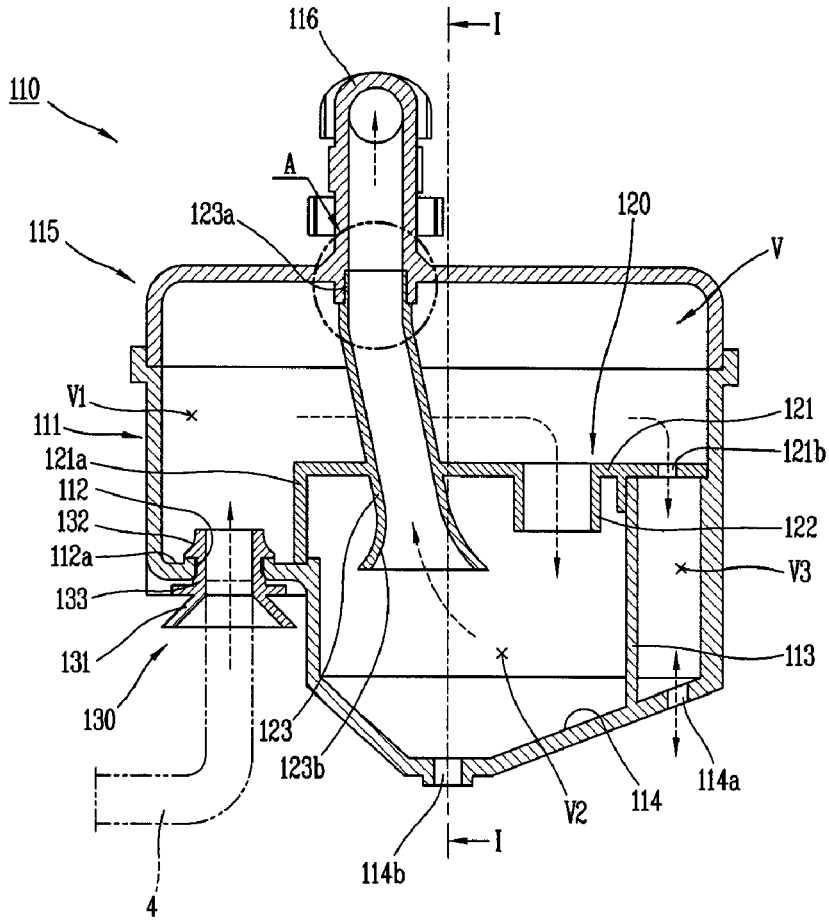
[Fig. 6]
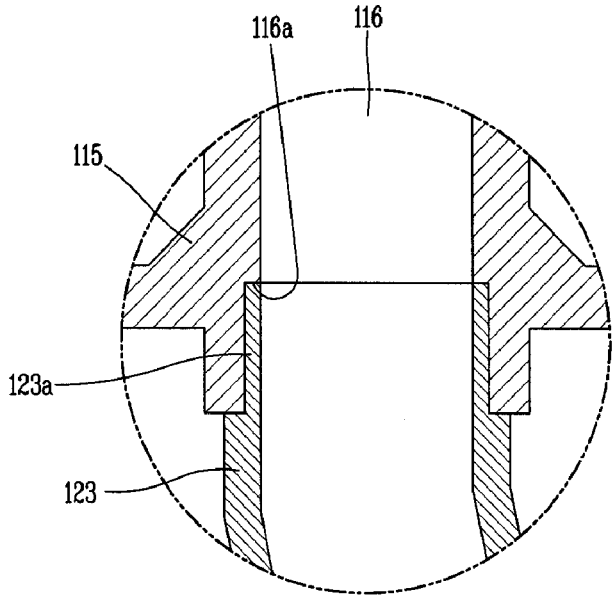

[Fig. 7]
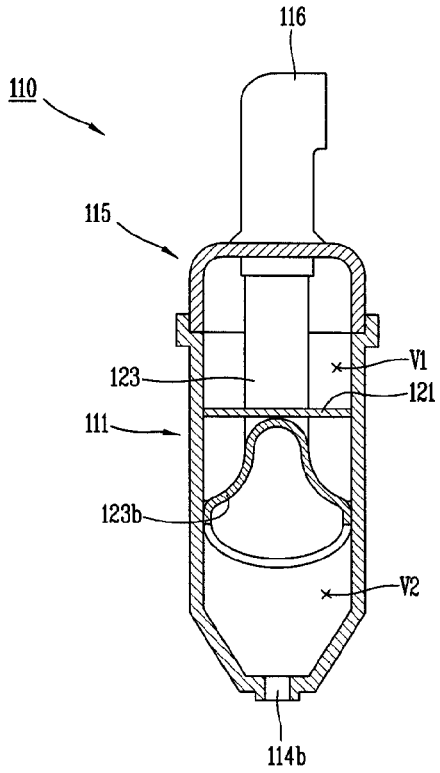
[Fig. 8]
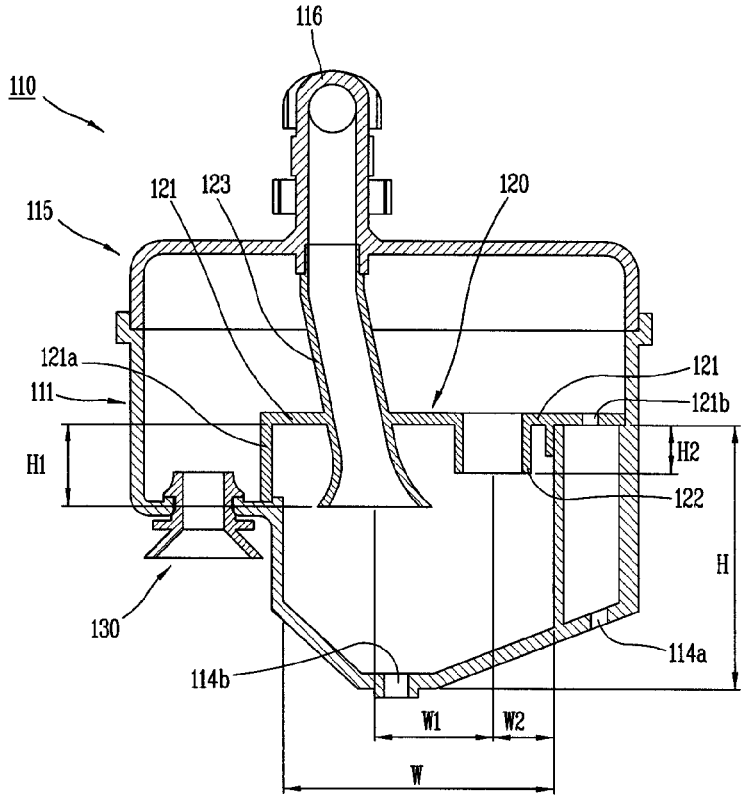

MUFFLER FOR COMPRESSOR

TECHNICAL FIELD

The present invention relates to a muffler for a compressor capable of reducing noise at a suction side of the compressor.

BACKGROUND ART

In general, a hermetic compressor includes a suction muffler disposed at a suction side thereof for attenuating impulsive noise from a valve, flow noise, pressure pulsation and the like, which occur when a refrigerant is sucked into a compression part. The suction muffler may include a noise space for reducing noise occurred when the refrigerant is sucked, an inlet formed at one side of the noise space to be connected to a suction pipe of a refrigerating cycle, and an outlet formed at another side of the noise space to be connected to a suction side of the compression part. The noise space may be divided into a plurality if necessary, or a plurality of noise spaces may be formed in parallel or in series in cases.

The suction mufflers may be classified according to their types applied to a compressor into a direct suction type or indirect suction type. The direct suction type muffler is configured such that its inlet is disposed close to the suction pipe penetratingly coupled to a hermetic casing of the compressor and accordingly refrigerant is directly sucked therein, whereas the indirect suction type muffler is configured such that the suction pipe is spaced apart from the inlet of the suction muffler with a certain interval and accordingly a refrigerant is sucked via an inner space of the hermetic casing.

DISCLOSURE OF INVENTION

Technical Problem

However, with the direct suction type muffler according to the related art, when the inlet and the outlet of the suction muffler are directly communicated with each other via a pipe, an amount of sucked refrigerant increases but there is a limit to reduce noise occurred from the compression part. In contrast, when a chamber is formed between the inlet and the outlet so as to make the two components indirectly communicated with each other, the noise reduction effect can be improved but a refrigerant suction loss may occur.

In order to solve the problem of the suction muffler for the compressor of the related art, one object of the present invention is to provide a muffler for a compressor capable of decreasing a refrigerant suction loss as well as effectively reducing noise occurred from a compression part.

Technical Solution

To achieve the object of the present invention, there is provide a muffler for a compressor comprising: a case having an inlet and an outlet and including at least two or more chambers formed therein, wherein one of the at least two or more chambers has at least one communicating hole through which inside and outside of the case are communicated with each other.

The muffler for the compressor is configured to have a chamber formed between the inlet and the outlet and also appropriately design sizes of a noise space and a communicating pipe, whereby a suction loss of a refrigerant sucked into the muffler for the compressor and pressure pulsation can all be reduced, so as to remarkably enhance a cooling capability of the compressor and a noise reduction effect. Also, a simplified assembly of the muffler allows a decrease of fabricating cost and improvement of productivity.

ADVANTAGEOUS EFFECTS

The present invention can design a noise space and a communicating pipe so as to reduce a suction loss of a refrigerant sucked into the suction muffler and simultaneously effectively maintain a balance of a suction pressure. Accordingly, the suction loss of the refrigerant and the pressure pulsation can be minimized, resulting in improvement of a cooling capability of the compressor and reduction of noise. In addition, an assembling structure of the muffler can be simplified, thereby decreasing fabricating cost and increasing productivity.

BRIEF DESCRIPTION OF THE DRAWINGS

FIG. 1 is a longitudinal cross sectional view showing an exemplary reciprocating compressor according to the present invention;

FIG. 2 is an assembled view showing a muffler for a compressor according to the present invention;

FIG. 3 is a view showing a lower surface of the muffler for the compressor shown in

FIG. 2;

FIG. 4 is a disassembled view showing the muffler for the compressor shown in FIG. 2;

FIG. 5 is a longitudinal cross sectional view showing a front surface of the muffler shown in FIG. 2;

FIG. 6 is an enlarged view of part "A" shown in FIG. 4;

FIG. 7 is a view taken along the line "I-I" of FIG. 5; and

FIG. 8 is a longitudinal cross sectional view illustrating a size of each component in the muffler shown in FIG. 4.

BEST MODE FOR CARRYING OUT THE INVENTION

Hereinafter, description will be given in detail of a suction muffler for a compressor in accordance with one embodiment of the present invention with reference to the accompanying drawings.

As shown in FIG. 1, a reciprocating compressor having a suction muffler for a compressor according to the present invention may include a compressor hermetic casing 1, a driving motor 2 installed inside the compressor hermetic casing 1, and a compressor main body 3 provided with a cylinder block 11, a connecting rod 12, a piston 13, a valve assembly 14, a discharge cover 15, a suction muffler 100 and the like, all required for compressing a refrigerant by using power from the driving motor 2.

As shown in FIGS. 2 to 5, the suction muffler 100 may include a case 110 installed in an inner space of the compressor hermetic casing 1 and having a noise space V formed for reducing noise occurred from the compressor main body 3, and a communicating pipe 120 installed in the noise space V of the case 110 for dividing the noise space V into a plurality of chambers V1, V2 and V3 and simultaneously guiding a refrigerant to the compressor main body 3.

As shown in FIGS. 2 to 4, the case 110 may include a lower case 111 having an upper side open and including an inlet 112 formed at a lower surface of the case 110 to be coupled to a suction pipe 4 penetrating the compressor hermetic casing 1 by a flexible connection member, and an upper case 115 having a lower side open to be coupled to the lower case 111 and including an outlet 116 formed at an upper surface of the case 110 to be coupled to the compressor main body 3.

As shown in FIGS. 3 to 5, in the lower case 111 having the inlet 112 formed at one side of the lower surface thereof, a first chamber V1 is formed at an upper side of the lower case 111 by a flange portion 121 of the communicating pipe 120 to be explained layer. The first chamber V1 is also communicated with the inlet 112. A second chamber V2 is formed at a lower side of the first chamber V1 by the flange portion 121. A third chamber V3, which is communicated with the inner space of the compressor hermetic casing 1 via a second communicating hole 114*a* as will be explained later, is formed at one side of the second chamber V2, namely, at an opposite side to the inlet 112 based upon the second chamber V2. Here, as a temperature of a refrigerant contained in the inner space of the compressor hermetic casing 1 becomes high, the third chamber V3 may serve to damp a heat-exchange down to some degree between the high temperature refrigerant and a low temperature refrigerant inside the suction muffler 100, and simultaneously serve to reduce noise transferred from the compressor main body 3 to the suction muffler 100 before being discharged into the inner space of the compressor hermetic casing 1.

As shown in FIGS. 4 and 5, the first chamber V1 and the second chamber V2 are communicated with each other via a first communicating portion 122 of the communicating pipe 120 to be explained layer. The second chamber V2 and the third chamber V3 are divided by a partition wall 113. The first chamber V1 and the third chamber V3 are divided by the flange portion 121 of the communicating pipe 120, and simultaneously communicated with each other via a first communicating hole 121*b* formed in the flange portion 121. The third chamber V3 and the compressor hermetic casing 1 are communicated with each other via a second communicating hole 114*a* formed in a lower surface 114 of the third chamber V3. The bottom of the second chamber V2 is downwardly inclined so as to form an oil discharging hole 114*b* at the lowermost portion. Here, the partition wall 113 may have a communicating hole (not shown) so as to communicate the second chamber V2 with the third chamber V3.

As shown in FIGS. 4 and 5, the first communicating hole 121*b* and the second communicating hole 114*a* are formed to have a section smaller than that of the third chamber V3. The oil discharging hole 114*b* is formed to have a diameter approximately similar to that of the second communicating hole 114*a*.

The inlet 112 is coupled to a suction guiding pipe 130, which is directly coupled to the suction pipe 4 penetrating through the hermetic casing 1 for directly guiding a refrigerant sucked from a refrigerating cycle into the noise space V of the suction muffler 100. The suction guiding pipe 130 is provided with an extending portion 131 formed at an outside thereof, namely, outwardly extending further from the noise space V of the suction muffler 100. A stopper 132 in a shape of a hook is formed at a portion coupled to the inlet 112 of the suction muffler 100 so as to prevent the separation of the suction guiding pipe 130. A coupling portion 133 is cylindrically formed between the extending portion 131 and the stopper 132 so as to allow the suction pipe 4 to be inserted therein. The suction pipe 4 and the coupling portion 133 can be adhered closely to each other or be coupled to each other by a gap as extremely narrow as a refrigerant not being leaked.

As shown in FIGS. 4 and 5, the upper case 115 is formed as an empty space for con-figuring the first chamber V1 together with the lower case 111. The outlet 116 is upwardly extended long from its central portion. The edge at which the outlet 115 starts may be formed to have a stepped supporting portion 116*a* or to be inclined so as to become upwardly narrower such that an upper end of the second communicating portion 123 of the communicating pipe 120 can be inserted therein and thusly supported, as shown in FIG. 6.

As shown in FIGS. 4 and 5, the communicating pipe 120 may include the flange portion 121 coupled to the lower case 111 for dividing the noise space V into the first chamber V1 and the second chamber V2, the first communicating portion 122 formed through one side of the flange portion 121 for communicating the first chamber V1 with the second chamber V2, and a second communicating portion 123 formed through one side of the first communicating portion 122 for directly connecting the second chamber V2 to the outlet 116. An edge surface of the flange portion 121 is closely adhered to an inner circumferential surface of the noise space V, whereas the first and second communicating portions 122 and 123 may be spaced apart from the inner circumferential surface of the noise space V by a certain gap.

The flange portion 121 is formed to have the same shape as a horizontal section of the noise space V so as to divide the noise space V. A bent portion 121*a* is formed at one side of the flange portion 121 to be supported by a stepped surface at which the inlet 112 of the lower case 111 is formed.

As shown in FIG. 8, a height H1 of the bent portion 121*a* is preferably formed to be as long as the partition wall 113 being protruded from a surface at which the inlet 112 is formed, thus to uniformly support the flange portion 121 at both sides. The height H1 of the bent portion 121*a* may be formed within half of a height H of the first chamber V1. The second communicating hole 121*b* for communicating the first chamber V1 with the third chamber V3 is formed at another side of the flange portion 121. The second communicating hole 121*b* may be formed to have a diameter shorter than that of the first or second communicating portion 122 or 123, considering the effect of reducing noise.

The upper end of the first communicating portion 122 is formed to be flush with the upper surface of the flange portion 121, while the lower end thereof extends to be protruded toward the second chamber V2. For example, the height H2 of the second communicating portion 123 may preferably be formed within about ¼ of the height H between the bottom surface of the first chamber V1 and the bottom surface of the flange portion 121. The first communicating portion 122 may preferably be formed to be spaced apart from the partition wall 113 by a certain interval, for example, formed within ¼ of a width W of the first chamber V1.

The second communicating portion 123, as shown in FIGS. 5 to 8, is formed to be slightly inclined in view of the configuration of the compressor main body 3. An upper end of the second communicating portion 123 is protruded from the flange portion 121 to be inserted in the outlet 116. The upper end of the second communicating portion 123 may be provided with a stepped portion 123*a* or formed to narrow upwardly, such that it can be stopped at the stepped portion 116*a* of the outlet 116 to be supported in a lengthwise direction. A lower end of the second communicating portion 123 is downwardly protruded from the flange portion 121. The length of the lower end of the second communicating portion 123 may be formed in the range that it is not shorter than the length of the lower end of the first communicating portion 122, namely, approximately in the same range of the height H of the bent portion of the flange portion 121. The lower end of the second communicating portion 123 may have a skirt portion 123*b* is formed at the lower end of the second communicating portion 123 having a width extending downwardly, so as to allow a smooth introduction of a refrigerant. The skirt portion 123*b* may extend to have a width as wide as being able to be curved by being pressed at front and rear wall surfaces of the lower case 111.

The communicating pipe 120 may preferably be formed of a flexible material with having thermal resistance or corrosion resistance, considering its fabrication or assembly.

Unexplained reference numeral 5 denotes a discharge pipe, and 112*a* denotes a stepped surface.

The suction muffler for the compressor according to the present invention having such configuration will be assembled as follows.

That is, the communicating pipe 120 is inserted in the lower case 111 for coupling.

The bent portion 121*a* of the communicating pipe 120 is loaded on the stepped surface 112*a* at which the inlet 112 is formed, and a plane portion (no reference numeral given) at an opposite side to the bent portion 121*a* of the communicating pipe 120 is loaded on the partition wall 113. Here, the skirt portion 123*b* of the second communicating portion 123 is pressed by the front and rear wall surfaces of the lower case 111 to be closely adhered thereto.

Next, a lower surface of the upper case 115 is inserted in an upper surface of the lower case 111 to be fixed to each other. The upper end of the second communicating portion 123 is inserted into the outlet 116 of the upper case 115 to be communicated with each other. Here, as the stepped portion 116*a* of the outlet 116 and the stepped portion 123*a* of the second communicating portion 123 are coupled to each other to be supported in their lengthwise direction, the bent portion 121*a* of the communicating pipe 120 and the lower surface of the flange portion 121 are closely adhered to each corresponding surface of the lower case 111 by a force pressing the upper case 115, by which the communicating pipe 120 can firmly be fixed.

In the meantime, an operation effect of the suction muffler for the compressor according to the present invention will be described as follows.

That is, when the compressor main body 3 installed inside the compressor hermetic casing 1 is driven, a refrigerant sucked into the inner space (no reference numeral given) of the compressor hermetic casing 1 is introduced into the communicating pipe 120 via the inlet 112 of the suction muffler 100. The introduced refrigerant then flows along the communicating pipe 120 to be sucked into a compression space of the compressor main body 3 via the outlet 116 with opening a suction valve (not shown) of the compressor. Here, as a connection member connected to the suction pipe 4 is disposed proximate to the suction guiding pipe 130 or directly connected to the suction guiding pipe 130, the refrigerant is directly sucked into the noise space V in the case 110 of the suction muffler 100 via the suction pipe 4. Accordingly, it is possible to prevent the refrigerant from being preheated in the inner space of the compressor hermetic casing 1 and to reduce a refrigerant suction loss, resulting in improvement of the performance of the compressor.

However, even if the refrigerant can directly be sucked into the noise space V of the suction muffler 100, since the oil discharge hole 114*b* cannot optionally be formed to have a greater size, a certain amount of refrigerant without being sucked may remain in the inner space of the suction muffler 100. Pressure and temperature of the refrigerant remaining in the inner space of the suction muffler 100 increase in cooperation with the continuous operation of the compressor main body 3, thereby lowering the efficiency of the compressor. However, as shown in the present invention, the second communicating hole 114*a* is formed at the lower surface of the suction muffler 100, and accordingly the refrigerant in the compressor hermetic casing 1 and the refrigerant in the suction muffler 100 mutually flow via the second communicating hole 114*a* according to the pressure difference therebetween, thereby to prevent the excessive increase in the inner space or temperature of the suction muffler 100, resulting in enhancing the efficiency of the compressor. Also, by forming a separate space in the inner pressure of the suction muffler 100, namely, the third chamber V3 for accommodating the second communicating hole 114*a*, the refrigerant in the compressor hermetic casing 1 and the refrigerant in the suction muffler 100 are primarily heat-exchanged in the third chamber V3, so as to flow into the first chamber V1 via the first communicating hole 121*b*. Accordingly, the refrigerant temperature in the compressor hermetic casing 1 is prevented from directly affecting the refrigerant temperature sucked into the communicating pipe 120 of the suction muffler 100, thereby enhancing the efficiency of the compressor. In addition, by further forming a type of resonance space in the third chamber V3, noise occurred in the suction muffler 100 can be reduced by a certain degree, whereby the noise which is discharged from the suction muffler 100 into the compressor hermetic casing 1 can be reduced, so as to attenuate compressor noise.

Industrial Applicability

The muffler according to the present invention can evenly be applied to hermetic compressors in which a suction pipe and a compressor main body are directly connected to each other.

The invention claimed is:

1. A muffler for a compressor comprising:

a case having an inlet and an outlet and including at least two or more chambers formed therein, wherein one of the at least two or more chambers has at least one communicating hole through which an inside and an outside of the case are communicated with each other, wherein the at least two or more chambers of the case comprise, a first chamber communicated with the inlet, a second chamber communicated with the outlet, and a third chamber directly communicated with at least one of the first or second chamber and having the at least one communicating hole through which the inside and the outside of the case are communicated with each other; and a communicating pipe disposed between the inlet and the outlet inside the case and configured to guide a refrigerant introduced into the inlet toward the outlet, comprising:

a flange portion configured to partition a noise space of the case into the at least two or more chambers;

a first communicating portion formed through the flange portion to have a predetermined length and configured to communicate two of the at least two or more chambers together; and a second communicating portion formed through the flange portion at one side of the first communicating portion to have a predetermined length and configured to communicate the second chamber at an outlet side of the first communicating portion with the outlet of the case, wherein one end of the flange portion is fixed to the case and an end of the second communicating portion is supported by the outlet of the case, such that the communicating pipe is fixed to the case.

2. The muffler of claim 1, wherein the at least one communicating hole is formed at a bottom surface of the one of the at least two or more chambers.

3. The muffler of claim 1, wherein the first chamber is formed above the second chamber, and the second chamber is formed to have an inclined bottom surface and has a further communicating hole at a lowermost point of the inclined surface.

4. The muffler of claim 1, wherein the communicating pipe has one side communicated with the one of the at least two or more chambers and another side communicated with the outlet.

5. The muffler of claim 1, wherein the third chamber having the at least one communicating hole does not accommodate the first and second communicating portions.

6. The muffler of claim 1, wherein the first communicating portion is formed such that an end of an outlet side thereof is not lower than the inlet.

7. Wherein a distance from an end of an inlet side of the first communicating portion to the flange portion is within ¼ of a distance from the flange portion to the lower end of the case.

8. The muffler of claim 1, wherein the inlet and an end of an inlet side of the second communicating portion are at approximately the same height with each other.

9. The muffler of claim 8, wherein a distance from the end of the inlet side of the second communicating portion to the flange portion is within ½ of a distance from the flange portion to the lower end of the case.

10. The muffler of claim 1, wherein the first and second communicating portions are all accommodated within a single chamber of the at least two or more chambers.

11. The muffler of claim 10, wherein a distance from a side of the second chamber to a center of the first communicating portion is within ¼ of a width W of the second chamber.

12. The muffler of claim 10, wherein a distance from a side of the second chamber to a center of the second communicating portion is within ½ of a width W of the second chamber.

13. The muffler of claim 1, further comprising a suction guiding pipe disposed at the inlet of the case and coupled to a suction pipe to be directly communicated with each other, the suction pipe being formed through a compressor casing to guide the refrigerant sucked from a refrigerating cycle.

* * * * *